US008752315B2

(12) United States Patent
Papierowski et al.

(10) Patent No.: US 8,752,315 B2
(45) Date of Patent: Jun. 17, 2014

(54) FIRE DOOR INSTALLATION AUDITING/VERIFICATION SYSTEM

(76) Inventors: David Karzimierz Papierowski, Borehamwood (GB); Sujanto Ferdi, Borehamwood (GB)

( * ) Notice: Subject to any disclaimer, the term of this patent is extended or adjusted under 35 U.S.C. 154(b) by 0 days.

(21) Appl. No.: 13/517,950

(22) PCT Filed: Dec. 21, 2010

(86) PCT No.: PCT/GB2010/002302

§ 371 (c)(1),
(2), (4) Date: Jun. 20, 2012

(87) PCT Pub. No.: WO2011/077078

PCT Pub. Date: Jun. 30, 2011

(65) Prior Publication Data

US 2012/0272587 A1 Nov. 1, 2012

(30) Foreign Application Priority Data

| | | |
|---|---|---|
| Dec. 21, 2009 | (GB) | 0922257.1 |
| Oct. 1, 2010 | (GB) | 1016567.8 |
| Nov. 3, 2010 | (GB) | 1018531.2 |

(51) Int. Cl.
*G09F 3/02* (2006.01)
*G09F 3/00* (2006.01)

(52) U.S. Cl.
CPC ..... *G09F 3/0289* (2013.01)
USPC ..... 40/606.07

(58) Field of Classification Search
USPC ..... 40/456, 488, 594, 606.07, 630, 907; 283/99, 100, 101, 103, 105; 428/101; 434/226
See application file for complete search history.

(56) References Cited

U.S. PATENT DOCUMENTS

| | | | | | |
|---|---|---|---|---|---|
| 1,716,290 | A * | 6/1929 | Beck | 283/52 |
| 3,736,006 | A * | 5/1973 | Polsky | 283/99 |
| 3,930,673 | A * | 1/1976 | Sanden | 283/105 |
| 4,621,837 | A * | 11/1986 | Mack | 283/105 |
| 5,207,458 | A * | 5/1993 | Treichel et al. | 283/81 |
| 5,702,127 | A * | 12/1997 | Korondi, Jr. | 283/81 |
| 6,027,598 | A * | 2/2000 | Anderson | 156/253 |
| 8,167,336 | B2 * | 5/2012 | Minor et al. | 283/80 |

FOREIGN PATENT DOCUMENTS

| | | |
|---|---|---|
| EP | 0043179 | 1/1982 |
| GB | 1596306 | 8/1981 |
| WO | WO 2009067736 | 6/2009 |

OTHER PUBLICATIONS

International Search Report issued in corresponding application No. PCT/GB2010/002302, dated Aug. 22, 2011 (6 pgs).
The BWF-Certifire; fire door & doorset scheme: "Scheme directory 2008/9: the complete list of certified members," London, Jul. 9, 2009 (32 pgs).
Office of Compliance: "Fire door safety," Washington, DC, US, Sep. 23, 2004 (2 pgs).

* cited by examiner

*Primary Examiner* — Joanne Silbermann
*Assistant Examiner* — Christopher e Veraa
(74) *Attorney, Agent, or Firm* — Hayes Soloway P.C.

(57) ABSTRACT

A fire door installation auditing/verification system includes a label that is adhered to a fire door in use. The label has a first portion adhered to the fire door, and a second, removable, portion, said second, removable, portion carrying detailed installation instructions for the fire door. The second, removable, portion is attached to the first portion such that, when the second portion is removed during installation, the first portion of the label is retained adhered to the fire door and provides a visual indication, post installation, that the installer has removed the second portion carrying the detailed installation instructions.

10 Claims, 9 Drawing Sheets

Figure 3A
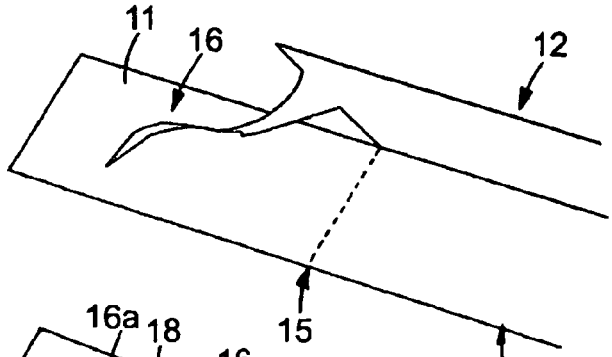
Figure 3B
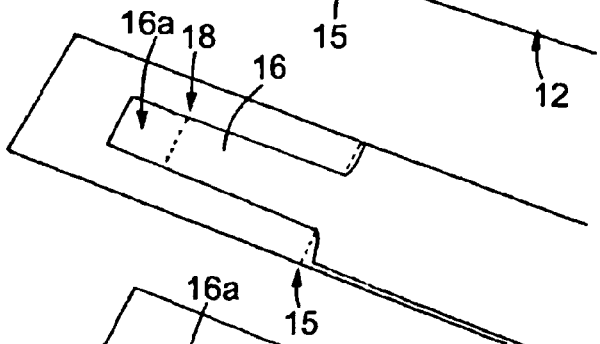
Figure 3C
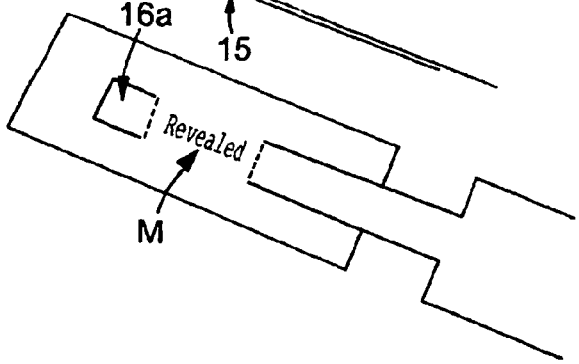
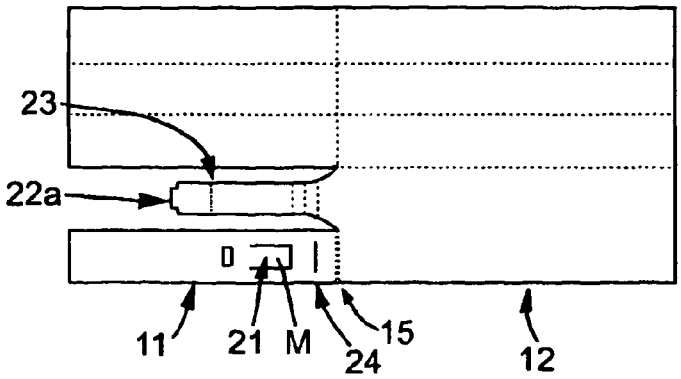
Figure 4A

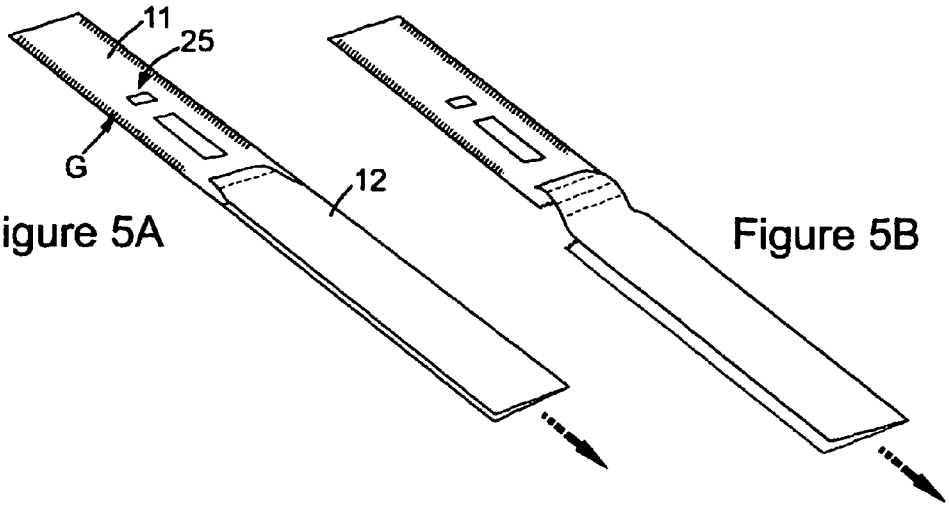
Figure 5A
Figure 5B
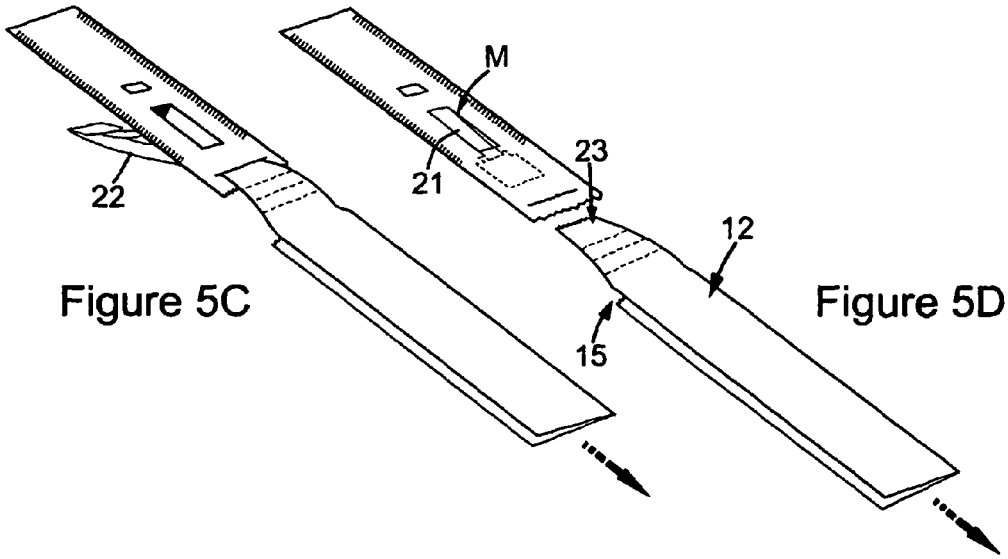
Figure 5C
Figure 5D

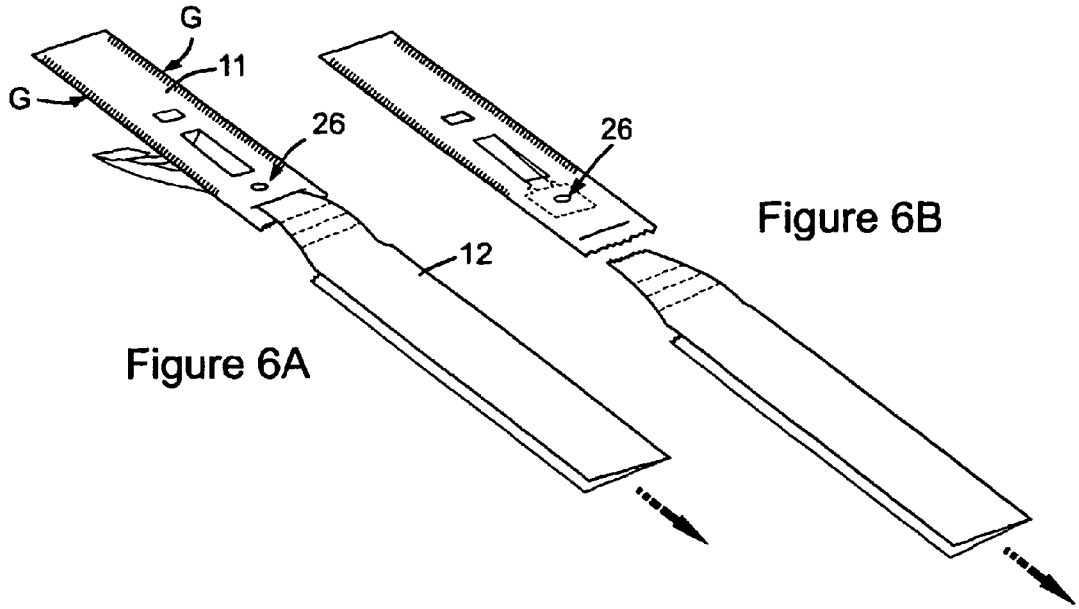
Figure 6A
Figure 6B
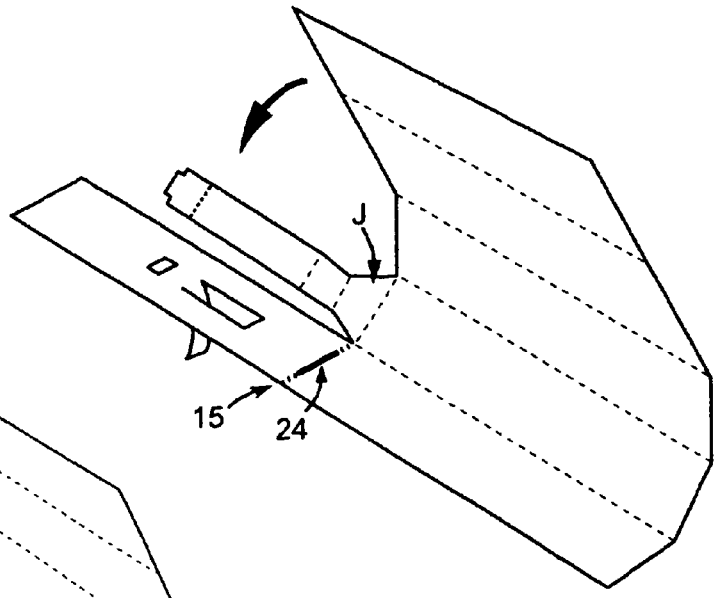
Figure 7
Figure 8
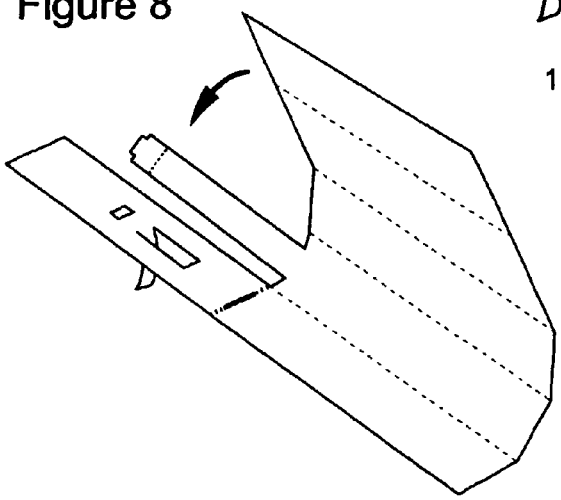

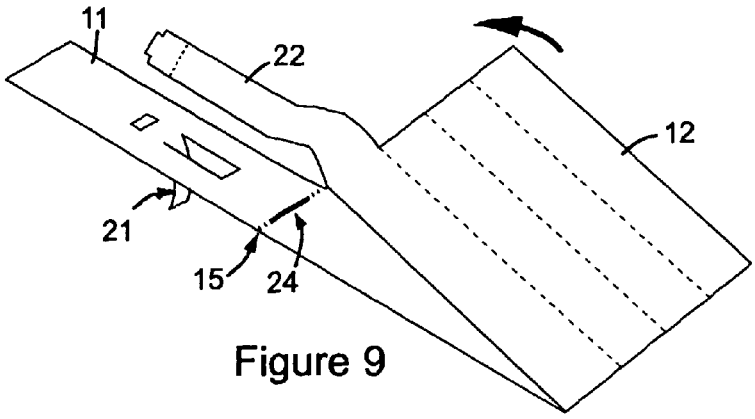
Figure 9
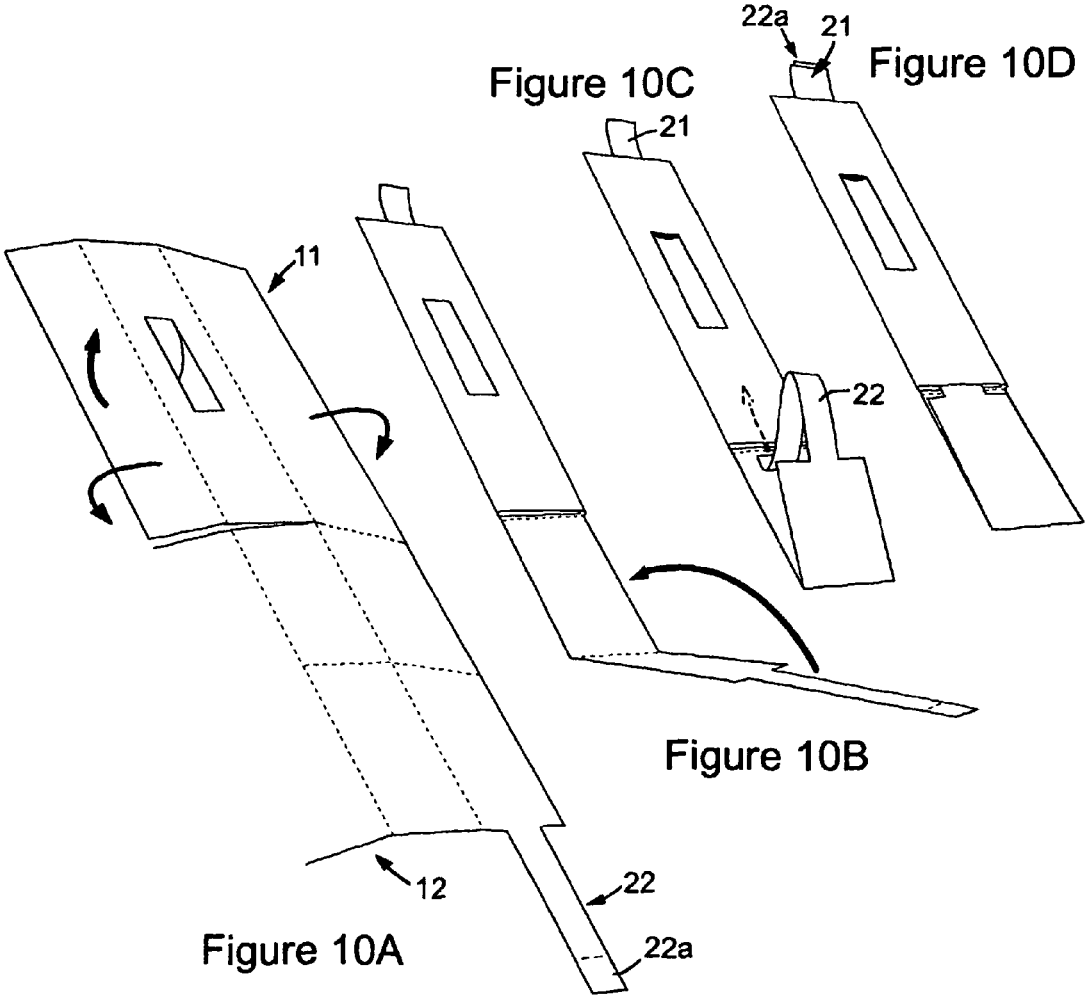
Figure 10C
Figure 10D
Figure 10B
Figure 10A

FIRE DOOR INSTALLATION AUDITING/VERIFICATION SYSTEM

FIELD OF THE INVENTION

The present invention relates to a system for fire door installation auditing/verification to establish that the fire doors have been provided with full installation instructions to enable correct installation.

BACKGROUND TO THE INVENTION

When a fire door is installed in a building it is important that it is installed correctly in accordance with building regulations and British Standards and according to the field of application report as issued by a fire consultant to ensure that it is capable of performing its function when required. Additionally, it is important that the Fire-door supplier can establish that full installation instructions have been provided to the installer in order to establish duty of care. It has been found that it is not uncommon for fire doors to be supplied with inadequate (or no) installation instructions, or instructions that are provided as loose sheets, which are typically thrown away during or after installation. Such instructions would generally include: instructions concerning the requirements for the doorframe; the specifications concerning requirements for door gaps between the door and the frame and the door and the floor: requirements regarding intumescent seals fitted to the door or door frame, the provision of adequate hinges and door latch and automatic closing devices, all of these being required to be provided to ensure that the fire doors are properly fitted and can perform the function for which they are provided.

Since fire doors can be fitted by any builder, who may or may/not adhere to the strict technical requirements it is an object of the invention to provide a means by which adequate instructions can be provided to an installer and which also include means for providing a visual indication that proper instructions for installation have been provided.

At present, instructions supplied with fire doors tend to be of two types, namely a minimal list of instructions to be attached or adhered to the fire door, which should not be removed, or a full list of instructions that comes loose with the packaging and is typically thrown away with the rubbish when installing. Subsequently, when a building inspector is examining a property, at the very most, the only indication of how to install the fire doors is the small minimal list which is normally stuck to the top of the door. However, such a minimal list is inadequate on its own in that it provides no indication whether full instructions had been provided or followed.

SUMMARY OF THE INVENTION

According to a first aspect of the present invention there is provided a fire door installation auditing/verification system comprising label means operatively adhered to a fire door, said label means having a first portion adhered to the fire door, and a second, removable, portion, said second, removable, portion carrying detailed installation instructions for the fire door, said second, removable, portion being attached to said first portion such that, when second portion is removed, said first portion of said label means is retained adhered to said fire door and provides a visual indication/verification, post installation, that the second portion carrying the detailed installation instructions has been removed.

According to a second aspect of the present invention there is provided I a fire door installation auditing/verification device comprising label means to be adhered to a fire door, said label means including a first portion to be adhered to a fire door, said first portion preferably, but not necessarily containing minimal information concerning the specification and installation of the door, and a second, removable, portion, said second, removable, portion carrying detailed installation instructions for the fire door, said second, removable, portion being attached to said first portion such that, when second portion is removed during installation, said first portion of said label means is retained adhered to said fire door and provides a visual indication, post installation, that the installer has removed the second portion carrying the detailed installation instructions.

Preferably, the visual indication is provided on the first portion and can be a flash or reveal portion, or means provided on the first portion of said label means to indicate the second portion has been removed, which flash or reveal portion may be concealed by said second portion and be revealed when said second portion is removed. Other forms of indication means can be provided, the primary function or requirement of the invention is to provide "proof" that full instructions were provided for installation and have subsequently been removed, thereby establishing the door supplier's duty of care establishing that the installer has been provided with full, comprehensive installation instructions. Further aspects of the present invention will become apparent from the following description and drawings.

BRIEF DESCRIPTION OF THE DRAWINGS

Preferred embodiments of the present invention will now be further described, by way of example only, with reference to the accompanying drawings, in which:

FIGS. 3A-C are perspective views of a two-part labelling system of a third embodiment of the invention in stages of assembly and deployment;

FIGS. 4A-E are perspective views of a two-part labelling system of a fourth embodiment of the invention in stages of assembly.

FIGS. 5A-5D are perspective views of the fourth embodiment in stages of removal of the second portion for use and exposing the indication of removal;

FIGS. 6A-6B are perspective views of a minor variant of the fourth embodiment in the latter stages of removal of the main information sheet, this variant having an extra reveal aperture;

FIG. 7 is a perspective view of a further minor variant of the fourth embodiment in an early stage of assembly, this variant having the insertion slot for the reveal actuating tab located in the centre of the tear line for separating the first and second portions and having an expansion joint;

FIG. 8 is a perspective view of a further minor variant of the fourth embodiment in an early stage of assembly, this variant further differing in that there is no 'expansion joint' on the reveal actuating tab;

FIG. 9 is a perspective view of a further minor variant of the fourth embodiment further differing in that the reveal actuating tab is aligned with the insertion slot for the reveal actuating tab from the outset (rather than on a part of the second portion that needs to be folded for that tab to align);

FIGS. 10A-D are perspective views of a fifth embodiment of the invention in stages of assembly, this embodiment being like the fourth but with the first portion folding to a slim form serving as a pouch for the reveal actuating tab;

DESCRIPTION OF THE PREFERRED EMBODIMENTS

Figure 1:
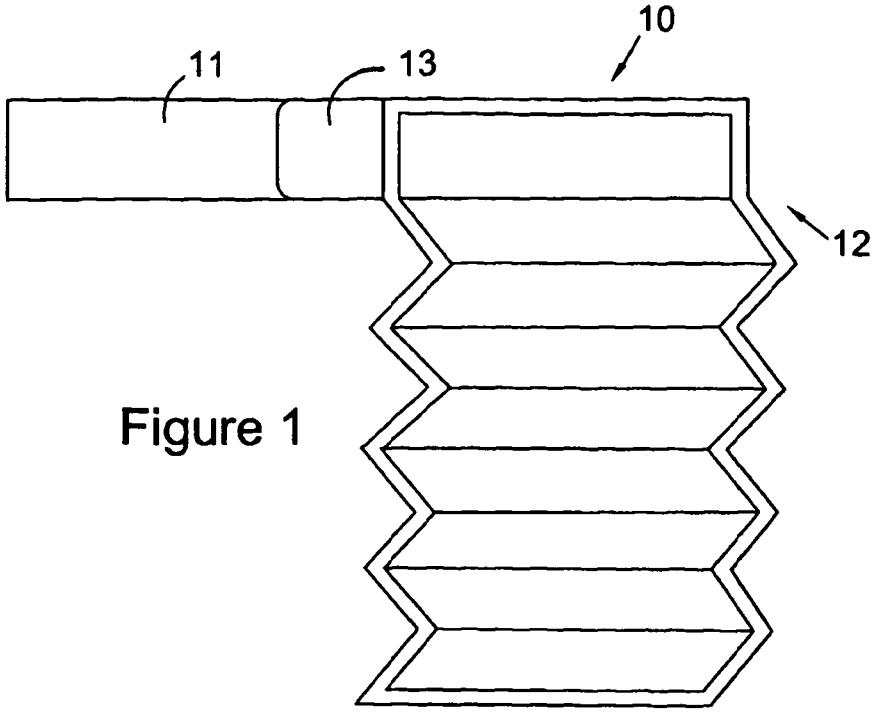
FIG. 1 is a perspective view of a two-part labelling system of a first embodiment of the invention.

Referring firstly to FIG. 1, this schematically illustrates a two-part labelling system for fire doors, in which the label means 10 includes a first portion 11, which can be provided with minimal instructions/specifications for installation of the fire door. The first portion 11 is typically permanently adhered to the top edge or surface of a fire door. A removable second portion 12 is provided, which may be removably adhered to first portion 11 in an overlap region 13.

The second portion 12 is, apart from the small overlap region 13, essentially adhesive-free. It is a sheet that includes a detailed set of installation instructions/specification regarding installation of the fire door which is detachable from the first portion 11 of the label means 10 at the connection/overlap region 13 such that when the detailed list comprising the second portion 12 is detached the lifting of the second portion 12 part of the overlap region 13 away from the first portion 11 of the label means 10 reveals on the first portion 11 printed information, or a symbol, or other indicia, indicating that the detailed instructions 12 had been attached but have subsequently been removed during installation. This indicates to any subsequent inspector that proper installation instructions had been provided to the installer.

It will be appreciated that due to the necessary size of the second portion 12 to convey all relevant instructions it will be appropriately furled or folded and preferably is concertinaed to be fitted to the edge of the door 20 substantially within the thickness of the door. Here it may be retained initially by packaging or a plastics material cover. When the packaging or cover is removed this will enable the detailed instructions/list to be removed and opened out so that the instructions can be followed by the installer. The installer may then dispose of the list after installation, although the door would still retain the first portion 11 which carries indication that the detailed instructions had been removed and preferably also carries minimal instructions.

Figure 2:
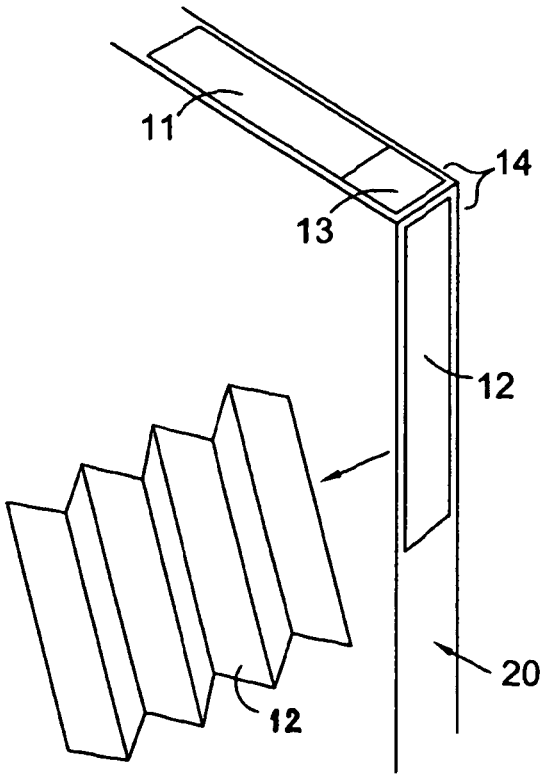
FIG. 2 is a perspective view of a variant of the two-part labelling system, suitable for having the main information sheet extending down the door edge.

Turning to FIG. 2, whilst the label means of FIG. 1 would most conveniently be applied solely to the top of the door 20, in the FIG. 2 variant the first portion 11 may be attached to the top of the door whilst the removable second portion 12 is positioned on an adjacent upright edge of the door. Here the illustrated label means 10 includes a connection means 14, which, when the second portion 12 is removed, will be connected to a removable portion 13. The removal of that removable portion 13 exposes/reveals a symbol or banner or provides another form of indication left exposed on the first portion 11 of the label means that establishes to an inspector that the second portion 12 has been present but removed.

Turning to FIGS. 3*a-c*, these show the working of an embodiment of the label means 10 that is simple and compact, yet effective. Here the label means 10 is formed from a single sheet, suitably of paper or card, much of which comprises the information sheet that is the second portion 12 and which suitably is, for example, a large rectangular sheet folded concertina-form like a map. In this embodiment the first portion 11 is an elongate tab projecting from an edge of the second portion 12 and which is detachable from it by tearing at a serration (perforated/weakened tear-line) 15. The first portion 11 is marked on its upper face with the indicating mark (eg coloured area) or message M for the later inspection and is covered over initially, following assembly, by an elongate cover tab 16 also projecting from an edge of the second portion 12.

As shown in FIG. 3B, the distal end/tip 16*a* of the elongate cover tab 16 is adhered to the first portion 11 near the distal end of the first portion 11 and the rest of the cover tab 16 lies over and conceals the indicating mark or message M. The distal end/tip 16*a* of the cover tab 16 is separable from the rest of the cover tab 16 at a serration (perforated/weakened tear-line) 18 so that when the information sheet/second portion 12 is pulled away by the user, the cover tab 16 will tear free at that tear-line and expose the indicating mark or message M (FIG. 3C).

Referring now to FIGS. 4A-D, these show the form and assembly of a fourth illustrated embodiment of the labelling means/device 10 that is more advanced than the preceding embodiments. This has a reveal panel 21 on the first portion 11 bearing the indicating mark/message M on a first face thereof and a reveal-actuating tab 22 on the second portion 12 that is arranged to pull the reveal panel 21 from a folded back position of the reveal panel 21 where the indicating mark/message M is concealed to an extended position where it exposes the indicating mark/message M.

FIG. 4A shows the labelling means/device 10 sheet spread out flat as it is initially when first pressed/cut from a larger rectangular sheet of card or paper. The first portion 11 of the device is formed as a first elongate tab extending out from an edge of the concertina-folding rectangular sheet form of the information sheet that is the second portion 12 of the device. Just as in the preceding embodiments, the first portion 11 is separable from the second portion 12 by tearing apart at a serration (perforated/weakened tear-line) 15 when the second portion 12 is pulled. The second portion 12 further has the elongate reveal-actuating tab 22 with a serration 23 (perforated/weakened tear-line) near its distal end 22*a*. The distal end 22*a* of the reveal-actuating tab 22 has a portion with adhesive on one side and which is adhered to the reverse of the tip of the reveal panel 21. The reveal panel 21 is formed as a cut-out portion/tab 21 of the first portion 11 of the label means partway along the length of the first portion 11. It is folded back on itself underneath the first portion 11 so that the indicating mark/message M on what was the upper face of the cut-out portion/tab 21 is concealed beneath the first portion 11 when the device is fully assembled.

Figure 4B:
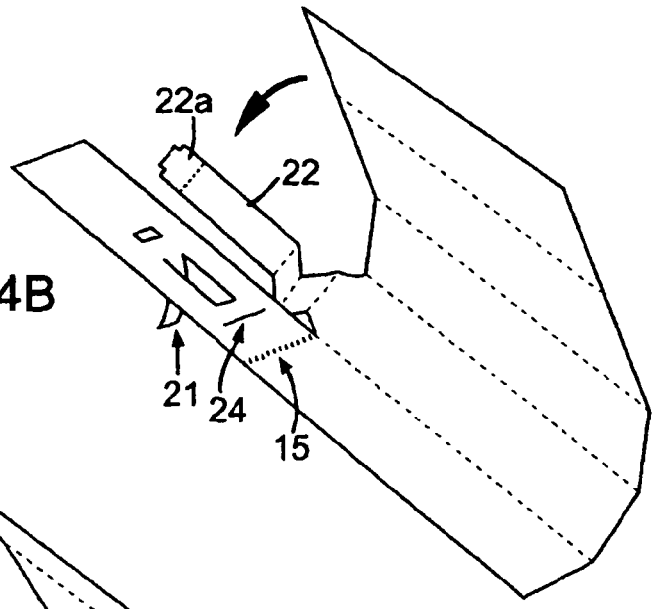
Figure 4C:
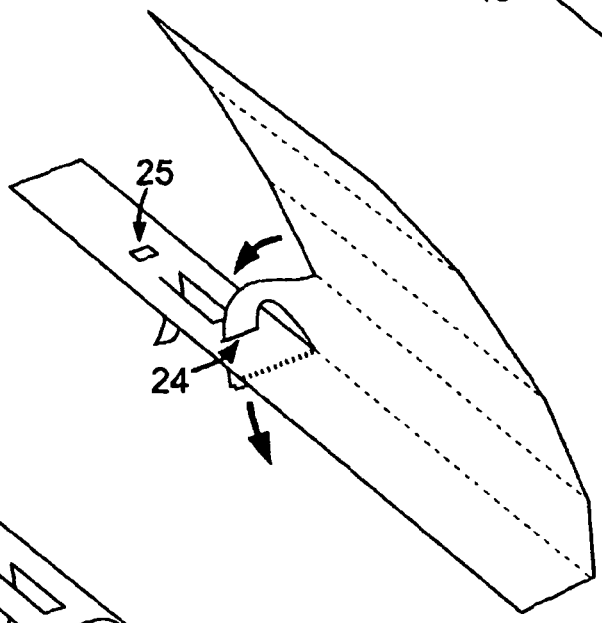
Figure 4D:
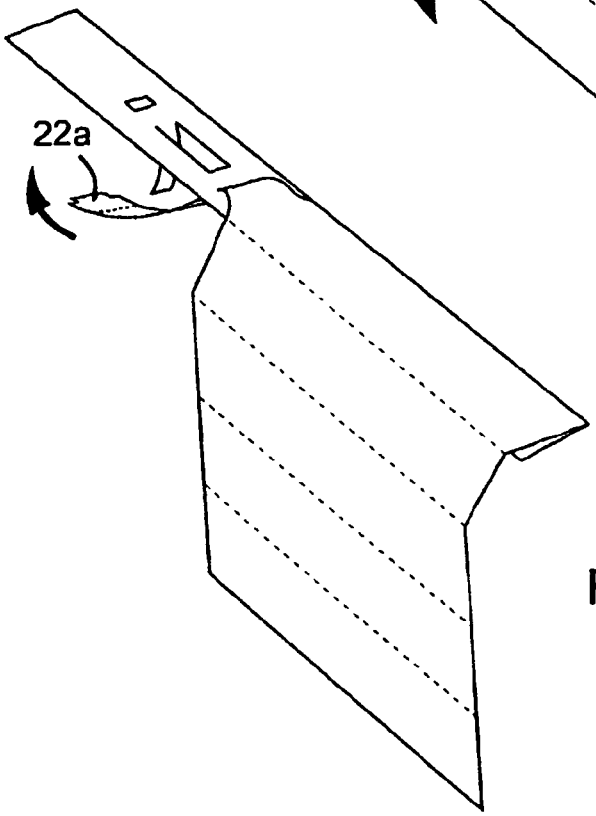
Figure 4E:
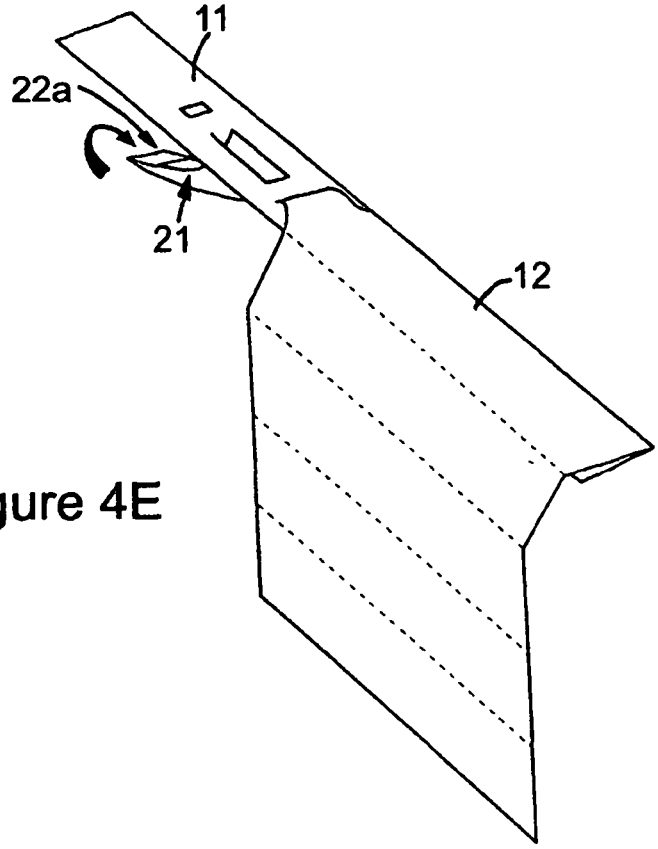
Figure 4F:
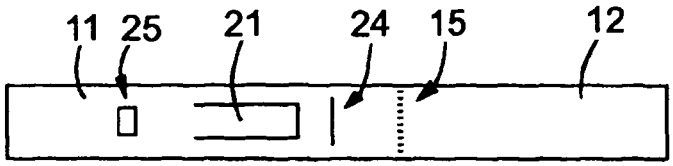
FIGS. 4F and 4G are, respectively, plan and side elevation views of the fourth embodiment (4F omitting the reveal actuating tab for ease of reference) during the final stage of assembly.
Figure 4G:
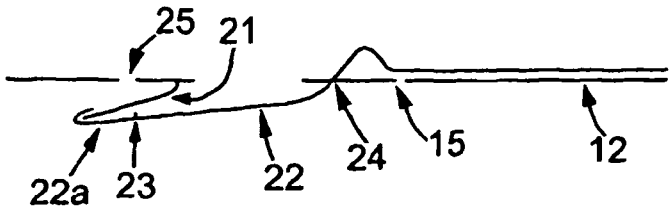

The first portion 11 further has a transverse insertion slot 24 partway along its length at a position between the weakened tear-line 15 and the cut-out portion 21. The reveal-actuating tab 22 is fed through the insertion slot 24 as illustrated in FIG. 4C and then the adhesive-bearing distal end portion 22*a* of the reveal-actuating tab 22 is adhered to the end of the folded-back cut out portion 21. The reveal-actuating tab 22 is held relatively closely and securely in the insertion slot 24 by virtue of the reveal-actuating tab 22 having a folding neck that broadens towards its base, thereby serving as a type of 'expansion joint' J on the reveal actuating tab 22 and with the reveal actuating tab 22 being wider than the cut-out tab 21.

Turning to FIGS. 5A-D, the assembled labelling device 10 is adhered to an edge, suitably the top edge, of a door by the manufacturer or distributor of the door using a strong adhesive G along the underside lateral edges of the device 10.

When the door is received and about to be installed, the second portion 12 is removed by the door installer. Pulling on the second portion 12 firstly breaks the tear-line 15 (FIG. 5B) and the second portion 12 then drags the reveal-actuating tab 22 with it, pulling the reveal-actuating tab 22 back out through the insertion slot 24 and simultaneously unfolding the folded-back cut-out portion/reveal panel 21 that is attached to the tip of the reveal-actuating tab 22 (FIG. 5C). The folded-back cut-out portion/reveal panel 21, when fully unfolded, will-cause the serration/tear-line 23 on the reveal-actuating tab 22 to separate (FIG. 5D), so that the second portion 12 is now fully disconnected from the first portion 1, the first portion 1 being left behind on the door. Note that the serration/tear-line 23 on the reveal-actuating tab 22 is suitably tougher/less readily separated than the serration/tear-line 15 between the first portion 11 and second portion 12 so that the latter is the first to separate. The serration/tear-line 23 on the reveal-actuating tab 22 is thus suitably with fairly spaced apart perforations while the serration/tear-line 15 between the first portion 11 and second portion 12 may be densely micro-perforated to tear more easily.

The cut-out reveal panel 21 is now fully unfolded and is partly held in place by the glued portion, being the remainder of the tab 22 beyond the serration 23. The remainder of the reveal actuating lab 22 serves as a ratchet arrangement so that the cut-out portion is anchored/retained stretched out exposing the indicator mark/message M after the second portion has been removed. This anchoring/ratchet effect is facilitated by having the reveal actuating tab 22, or at least its distal end 22*a*, broader than the width of the reveal panel/cut-out 21.

The unfolding has the effect of exposing/displaying the indicating mark/message M on the cut-out portion 21 as proof to a later inspector. The unfolding that occurs when the second portion is pulled off, provides absolute evidence of the second portion having been present—otherwise the 'proof' would not have been exposed.

In the embodiment of FIGS. 4A-4G there is an extra opening 25 in the first portion 11 overlying where the back of the reveal panel 21 will be in the assembled device 10 and which may help verify to the manufacturer/distributor who fits the device 10 to the door that the device 10 is properly primed. Furthermore, turning to FIGS. 6A and 6B, a yet further opening 26 in the first portion 11 may be provided at a location between the cut-out 21 and the insertion slot 24 to allow the detached distal end 22*a* of the reveal-actuating tab 22 to be seen through the first portion 11 as a further confirmation of the proof given by indicating mark/message M.

Referring to FIGS. 7, 8 and 9, these show minor variants of the labelling device 10 from the FIGS. 4 to 7 embodiments. In FIG. 7 the variant has an 'expansion joint' J on the reveal actuating tab 22 but differs from the previous embodiments/variants in that the insertion slot 24 is located at the serration/tear-line 15 between the first portion 11 and second portion 12. In FIG. 8 the variant differs in that it has has no 'expansion joint' J on the reveal actuating tab 22.

In FIG. 9 the reveal actuating tab 22 differs in that it is aligned with the insertion slot 24 for the reveal actuating 22 tab from the outset. The reveal actuating tab 22 in the FIG. 9 variant is on the opposing edge of the information sheet second portion 12 to the first portion 11 and is directly aligned with the first portion 11. This contrasts with the other embodiments where the reveal actuating tab 22 is alongside the first portion 11 on an adjacent folding panel part of the second portion and needs to be folded for that tab 22 to align with insertion slot 24.

FIGS. 10A-D are perspective views of a fifth embodiment of the invention in stages of assembly. This embodiment has the first portion 11 of several (e.g. three) folding panels folded together to a slim form serving as a pouch/flat tube for the reveal actuating tab 22. This embodiment is easy to assemble and can be very slim and avoids the need for an insertion slot 24. It is particularly well-suited for situations where the door is a replacement door formed from a blank and where the installer often will need to rebate/form a groove 20 mm or so into the edge of the door to install intumescent sealing strip and thereby leaving only a slim space for the labelling device 10 to be fitted. In this embodiment the second portion 12 is folded up and suitably is concertinaed to be 40 mm wide whilst the first part 11 is folded to a width of as little as 10 mm only.

Further variants and embodiments of the invention are within the scope of the present as set forth in the claims hereinafter. In a variation of the FIG. 3 embodiment, the distal end of cover tab 16 may be inserted into a slit, slot, aperture or pocket of the first portion 11 in addition or, preferably, in alternative to being held to the first portion 11 by adhesive. Here the distal end of cover tab 16 need not be detachable and the slit, slot, aperture or pocket will hold the cover tab 16 down covering and concealing the indicating mark or message M until the second portion 12 is pulled away by the user.

Figure 11A:
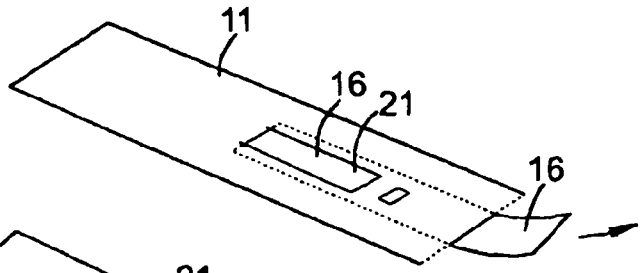
FIGS. 11A-B are perspective views of a further simpler embodiment of the invention in stages of reveal.
Figure 11B:
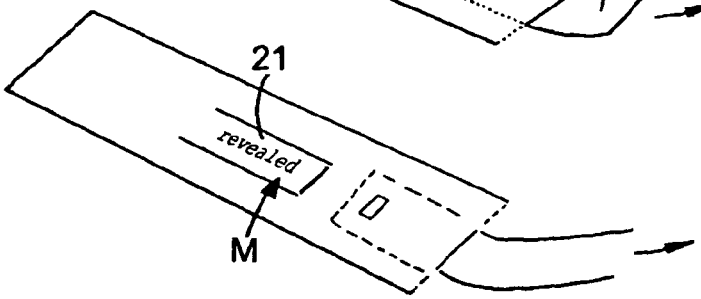

A yet further pair of comparatively simple embodiments of the invention are set out in FIGS. 11, 11B and 12A, 12B. In FIGS. 11A, 11B the first portion 11 of the labelling device 10 is provided with a reveal/cut-out 21 similar to the FIG. 4 embodiment but here the cover tab 16 is not serving as a reveal actuating tab and is not adhered to the reveal/cut-out 21 but simply covers it until the second portion 12 is pulled away by the door installer. The reveal/cut-out 21 is not folded back and the mark/message M is simply covered by the tab 16. The cover tab 16 extending from the second portion 12 may be of a narrow width to slot into the area of the cut-out 21 or, as illustrated, is broader than the cut-out 21 and slides over it.

Figure 12A:
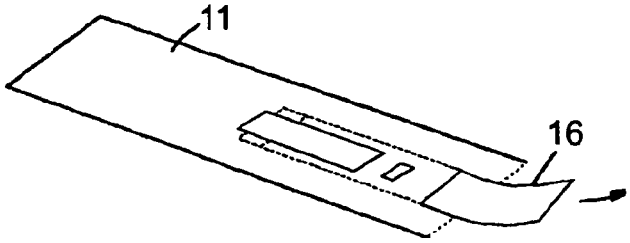
FIGS. 12A-B are perspective views of a yet further simpler embodiment of the invention in stages of reveal.
Figure 12B:
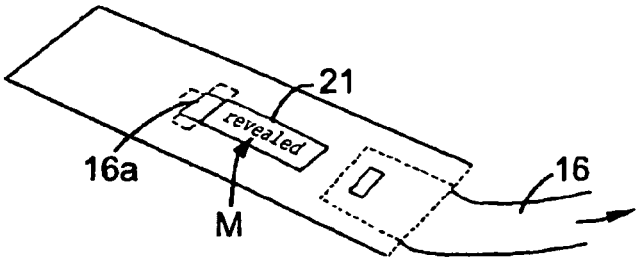

In FIGS. 12A, 12B the first portion 11 of the labelling device 10 is again provided with a reveal/cut-out 21 and the cover tab 16 is again simply to cover the mark/message M, but here the distal end 16*a* of the cover tab 16 is detachable and adhered to the first portion 11 to be left behind when the second portion 12 is pulled away.

Figure 13A:
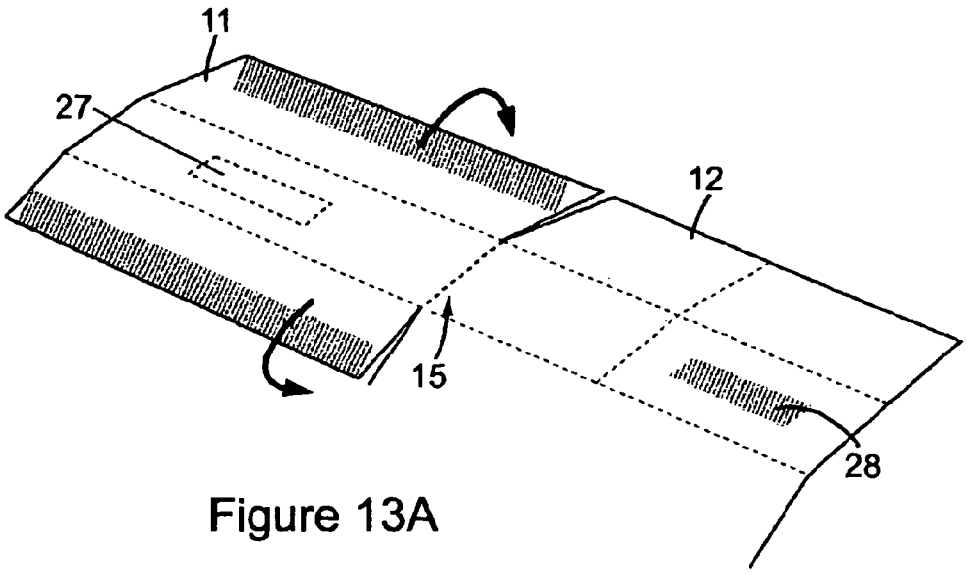
FIGS. 13A-C, show a yet further embodiment in successive stages of deployment.
Figure 13C:
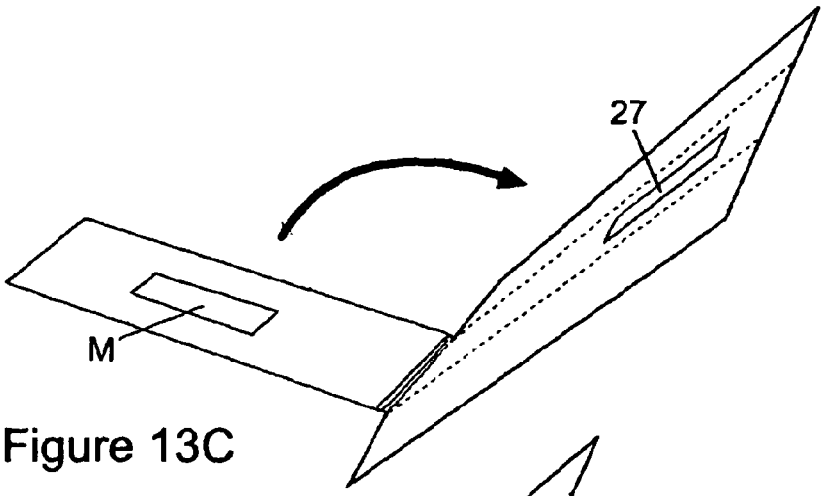
Figure 13B:
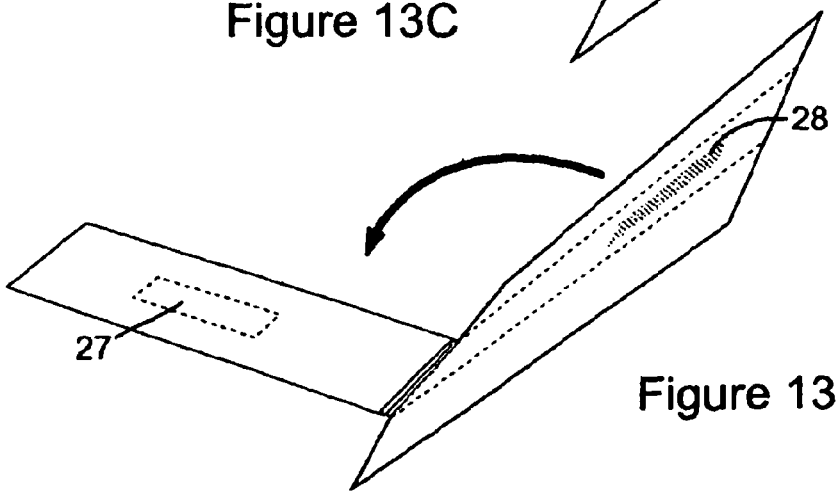

Turning to FIGS. 13A-C, these show a further embodiment in successive stages of deployment. Here the message M on the first portion 11 is initially hidden under a cover panel 27 on the first portion 11. As with earlier embodiments, the first portion 11 suitably comprises a number of elongate panels folded together to form a slim tube that is adhered to the door edge and the second portion 12 carrying the detailed instructions is detachable from the first portion 11 at a perforated tear-line 15. The cover panel 27 is adapted to be detached from the first portion 11, being delimited by a perforated perimeter extending around all four sides so that it may be torn away, as the second portion 12 is pulled away, in order to provide a window that exposes the message M. The top surface of the cover panel 27 is adhered to an overlying part of the second portion 12 so that the cover panel 27 is pulled off with the second portion 12. The top surface of the cover panel 27 or opposing area 28 on the second portion 12 for this purpose has adhesive pre-applied on it covered by a strip that is removed when the device is fitted to a door. In a variant of the above embodiment the cover panel 27 might be extended the full length of the first portion 11 hence only needing 2 lines of perforations (and these could be located on the fold lines that form the tube). In a yet further variant of this embodiment a reveal actuating tab extending from the second portion 12 may be used, stuck to the cover panel 27, rather than adhering the main body of the second portion 12 to the cover panel 27.

In conclusion, the present invention provides a fire door installation auditing/verification device and system by means of which complete installation instructions can be provided to an installer and which includes means for providing a visual indication subsequent to fitting, that proper instructions for installation had been provided and removed, whilst retaining minimal instructions permanently to the door, for future inspection. Thus, the door supplier can readily establish duty of care in respect of the supply of suitable installation instructions.

The invention claimed is:

1. A fire door installation auditing/verification system for verifying that detailed installation instructions have been provided, the system comprising label means operatively adhered to a fire door, said label means having a first portion adhered to the fire door, and a second, removable portion, said second, removable portion carrying detailed installation instructions for the fire door, said second, removable portion being attached to said first portion such that, when second portion is removed, said first portion of said label means is retained adhered to said fire door and provides a visual indication/verification, post installation, that the second portion carrying the detailed installation instructions had been provided and has been removed, in which the visual indication is on a cut-out reveal panel or otherwise movable part that is able to move from an initial state where the visual indication is concealed to a second state where the visual indication is exposed and wherein the second portion has a reveal actuating tab to push or pull the movable part to move it to the exposed state where the visual indication is revealed.

2. A fire door installation auditing/verification system according to claim 1, in which the second portion comprises a sheet having the reveal actuating tab projecting from an edge thereof.

3. A fire door installation auditing/verification system according to claim 2, in which the reveal actuating tab and the first portion are both tabs that project from the second portion, the reveal actuating tab being alongside the first portion on a common edge of the sheet or being on opposing edges of the sheet.

4. A fire door installation auditing/verification system according to claim 1, in which the reveal actuating tab has a distal end that has a weakened line or tear-line to be detachable from the rest of the cover tab.

5. A fire door installation auditing/verification system according to claim 1, in which the reveal actuating tab has a distal end that is adhered to the reveal panel.

6. A fire door installation auditing/verification system according to claim 1, in which the first portion has an insertion aperture therethrough into which the reveal actuating tab inserts to reach the reveal panel.

7. A fire door installation auditing/verification system according to claim 1, in which the reveal actuating tab has an expansion neck portion.

8. A fire door installation auditing/verification system according to claim 1, in which the first portion and second portion are formed from a common sheet and separable at a serration or weakening line or tear-line.

9. A fire door installation auditing/verification system according to claim 1, in which the first portion has one or more fold lines to fold to define a flat tube or pouch.

10. A fire door installation auditing/verification system according to claim 9, in which the flat tube or pouch of the first portion receives the reveal actuating tab therein.

* * * * *